US006588338B2

(12) United States Patent
Schmutz

(10) Patent No.: US 6,588,338 B2
(45) Date of Patent: Jul. 8, 2003

(54) CLEANING DEVICE FOR PRINTING-PRESS CYLINDERS

(75) Inventor: Torsten Schmutz, Bobingen (DE)

(73) Assignee: Baldwin Grafotec GmbH (DE)

( * ) Notice: Subject to any disclaimer, the term of this patent is extended or adjusted under 35 U.S.C. 154(b) by 0 days.

(21) Appl. No.: 09/936,384

(22) PCT Filed: Jan. 5, 2001

(86) PCT No.: PCT/EP01/00062

§ 371 (c)(1),
(2), (4) Date: Nov. 14, 2001

(87) PCT Pub. No.: WO01/51283

PCT Pub. Date: Jul. 19, 2001

(65) Prior Publication Data

US 2002/0157550 A1 Oct. 31, 2002

(30) Foreign Application Priority Data

Jan. 8, 2000 (DE) ..... 100 00 557

(51) Int. Cl.[7] ..... B41F 35/00

(52) U.S. Cl. ..... 101/425; 101/423; 101/424; 15/256.51

(58) Field of Search ..... 101/425, 423, 101/424; 15/256.5, 256.51, 256.52, 256.53; 242/423.1, 538.2, 596.1, 598.3

(56) References Cited

U.S. PATENT DOCUMENTS 2,859,656 A * 11/1958 Lemieux ..... 352/90
4,344,361 A 8/1982 MacPhee ..... 101/425
4,981,078 A * 1/1991 Dettinger et al. ..... 101/424
5,009,161 A * 4/1991 Wirz ..... 101/425
5,519,914 A 5/1996 Egan

FOREIGN PATENT DOCUMENTS

| | | | |
|---|---|---|---|
| DE | 3005469 | 10/1980 | ..... 35/6 |
| DE | 4027505 | 3/1991 | ..... 1/2 |
| DE | 4135892 | 5/1993 | |
| DE | 4211310 | 10/1993 | ..... 35/6 |
| DE | 4305153 | 8/1994 | ..... 35/6 |
| DE | 4319258 | 12/1994 | ..... 35/6 |
| DE | 29516348 | 12/1995 | |
| DE | 19543518 | 5/1997 | ..... 35/6 |
| DE | 19725505 | 12/1998 | |
| EP | 0539771 | 12/1994 | |
| EP | 0795403 | 9/1997 | |

OTHER PUBLICATIONS

German Search Report No. 100 00 557.8 dated Aug. 28, 2000.

* cited by examiner

*Primary Examiner*—Leslie J. Evanisko
*Assistant Examiner*—Leo T Hinze
(74) *Attorney, Agent, or Firm*—Ostrolenk, Faber, Gerb & Soffen, LLP

(57) ABSTRACT

A cleaning device for printing machine cylinders and bearings (2, 60) for this for the rotatable mounting of a cloth spindle (4, 92) for a cleaning cloth. At least one of the bearings (2, 60) has a bearing bush (14, 64) which is provided with an external thread (16, 66) and which can therefore be screwed into an internal thread (17, 67) of a side part (20, 70).

5 Claims, 3 Drawing Sheets

CLEANING DEVICE FOR PRINTING-PRESS CYLINDERS

BACKGROUND OF THE INVENTION

1. Field of the Invention

The invention relates to a cleaning device for printing machine cylinders. The device includes a clean cloth spindle and a dirty cloth spindle between which the cloth is driven and contacts a cylinder to be cleaned. The invention concerns bearing units for the spindles including novel bearing bush arrangements.

2. Prior Art

These devices are known from practice. Further prior art is known from the following publications:

U.S. Pat. No. 5,519,914,
DE 197 25 505 A1,
EP 0 539 771 A1,
EP 0 795 403 A1,
DE 295 16 348 U1,
U.S. Pat No. 4,344,361=
DE 30 05 469 C2,
DE 43 05 153 C1,
DE 40 27 505 A1,
DE 43 19 258 A1,
DE 42 11 310 A1,
DE 41 35 892A1,
DE 195 43 518 A1.

Known printing machine cylinder cleaning devices of this type normally form a structural unit which is known as a "washing beam". Such a washing beam is moveable between a basic position, in which it is at a distance from the printing machine cylinder to be cleaned, and a washing position, in which a portion of a washing-cloth is pressed onto the outer surface of the printing machine cylinder by a pressure element of the washing beam. The washing cloth is in each case then transported further on by the amount of a predetermined cloth portion, so that a new clean washing-cloth portion is opposite the printing machine cylinder when the washing beam is moved back from the washing position into the basic position. The washing cloth is transported further on this way by means of a freewheel drive on the dirty-cloth spindle. The freewheel drive acts in the manner of a ratchet so that during the movement of the washing beam in the direction from the washing position to the basic position, the drive drives the dirty-cloth spindle, but, during the reverse movement from the basic position to the washing position, the drive rotates idly in relation to the dirty-cloth spindle, that is without corotating the spindle. The washing cloth on the clean-cloth spindle may be dry and may be moistened with fluid on its path between the clean-cloth spindle and the pressure element or directly at the pressure element by a moistening device. It is also known to have a moist washing cloth on the clean-cloth spindle. Within the scope of the present invention, the washing cloth is called a "cleaning cloth", because the invention can also be used for dry cleaning cloths.

Particularly when the cloth movement starts, the dry-cloth spindle does not rotate more quickly than the dirty-cloth spindle can receive the cleaning cloth and does not follow on when the dirty-cloth spindle stops, which would result in a loosening and sagging of the cleaning cloth and consequently in the risk of the loose washing cloth being picked up by the printing machine cylinder and carried along. It is know to provide the clean-cloth spindle with a sustained-action brake. This consists, in the prior art, of a brake lining which is prestressed radially against a bearing bolt by a screw via a spring. The disadvantage of this is that even a small rotational movement of the screw may generate too strong or too weak a braking action. A small change in screw excursion results in a pronounced variation in braking force. The braking force therefore cannot be set with sufficient accuracy, and it changes relatively sharply in the event of wear of the brake lining.

The bearings of the clean-cloth spindle and of the dirty-cloth spindle each have a bearing bush which is provided at one end with a flange. The bearing bush and the flange together consist of a one-piece part. To produce this, a relatively large piece of material is necessary, from which a large amount of material has to be removed by cutting in order to form the bush. The flange has three passage holes for receiving screws, by means of which the bearing element consisting of the bearing bush and flange can be screwed to a side part of the cleaning device. In this side part locating bores are formed, into which the bearing bush is fitted. Furthermore, triangular depressions for receiving the triangular flanges are formed around the locating bores in the side parts. The bearings of the spindles have to be positioned relative to one another with great accuracy, so that the washing cloth runs exactly at right angles to the spindles and over the pressure element, by means of which in each case a cloth portion can be pressed onto the outer surface of the printing machine cylinder to be cleaned. Furthermore, care must be taken to ensure that the press-on pressure of the cloth is equal over the entire cylinder length. The production of the locating bores in the side parts and the production of the bearing elements consisting of the bearing bush and flange are costly.

SUMMARY OF THE INVENTION

The invention is intended to achieve the object of designing the bearing arrangements of the spindles in such a way that they can be produced in a shorter time and more cost-effectively, without avoiding sufficient accuracy in the positioning of the bearings.

This object is achieved, according to the invention.

A cleaning device for printing machine cylinders according to the invention has at least one of the bearings with a bearing bush which is provided with an external thread. It, therefore, can be screwed into an internal thread of the respective side part. An inner bearing part, which is designed for receiving a spindle end to be carried by the part, extends axially at least partially through the bearing bush and is positioned in the bearing bush.

The invention makes it simpler and less expensive to produce and assemble the cleaning device and reduces the production time and assembly time.

The invention is suitable, in particular, for cleaning of rubber-blanket cylinders in offset printing machines with a dry cleaning cloth or for washing with a moist washing cloth, but it may also be used for the cleaning of other cylinders in offset printing machines and in other types of printing machines.

BRIEF DESCRIPTION OF THE DRAWINGS

The invention is described below, by means of a preferred embodiment as an example, with reference to the drawings in which.

DESCRIPTION OF A PREFERRED EMBODIMENT

Figure 1:
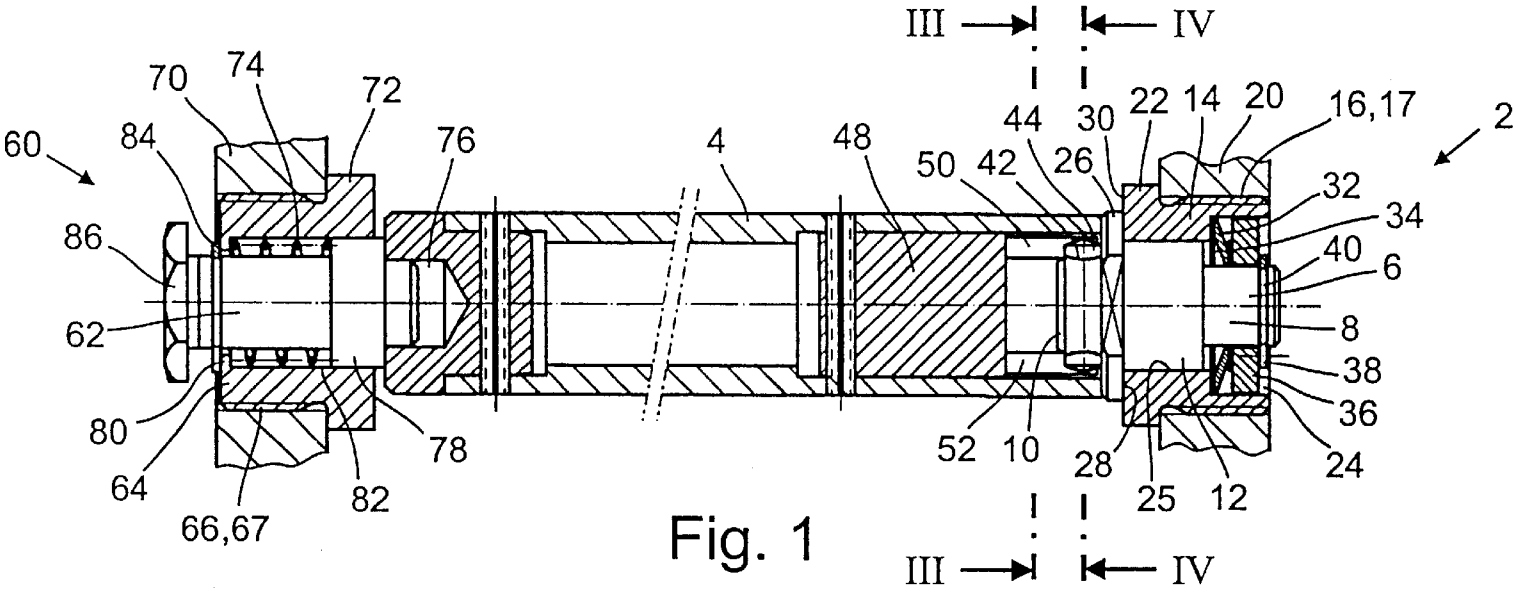
FIG. 1 shows a cutaway axial section through a clean-cloth spindle of a cleaning device according to the invention for printing machine cylinders.

FIG. 1 shows, at its right-hand end, a bearing and braking unit 2 for the mounting and sustained-action braking of a spindle 4, in particular of a clean-cloth spindle, onto which a cleaning cloth, not illustrated, is wound.

The bearing and braking unit 2 contains a bearing bolt 6 which has an outer end portion 8, an inner end portion 10 and a sliding-bearing portion 12 between the two end portions 8 and 10. The portion 12 has a larger diameter then the two end portions 8 and 10 and is mounted rotatably in a bearing bush 143 with which it forms a sliding bearing.

The bearing bush 14 has an external thread 16 with which it is screwed into an internal thread 17 and a side part 20 of the washing beam from the inside of the washing beam. The bearing shell 14 has, at its inner end, an annular collar 22 which projects radially outward beyond the external thread 16 and which bears against the inner face of the side part 20.

On its outer face distant from the annular collar 22, the bearing bush 14 has a cylindrical depression 24 which has a larger diameter than its sliding-bearing surface 25. The outer end portion 8 of the bearing bolt 6 is located predominantly within the cylindrical depression 24 of the bearing bush 14 and either does not project axially beyond this or projects only a little distance.

Between its sliding-bearing portion 12 and its inner end portion 10, the bearing bolt 6 has a radially outwardly projecting annular collar 26 which has a larger diameter than the sliding-bearing portion 12 and which comes to bear, with its end face 28 facing the bearing bush 14, against an inner end face 30, located opposite the end face 28, of the bearing bush 14. These two end faces 28 and 30 are pressed axially against one another resiliently by a compression spring 32 which is arranged on the outer end portion 8 of the bearing bolt 6 and which is clamped with axial prestress between the bearing bush 14 and the bearing bolt 6. The compression spring 32 is clamped between an outwardly pointing end face 34 facing away from the inner end face 30 and located in the cylindrical depression 24 of the bearing bush 14, against which end face 34 said compression spring comes to bear, and an annular disk 36, against which said compression spring likewise comes to bear. The annular disk 36 is held axially by a supporting element, for example a securing ring 38, inserted into a circumferential groove 40 which is formed at the outer end of the outer end portion 8 of the bearing bolt 6. In this case, the securing ring 38 is supported, in the circumferential groove 40 of the bearing bolt 6, on a groove end face 41 which is directed toward said end face 28 of the bearing-bolt annular collar 26 and which thereby points inward in the same direction as the inner end face 30 of the bearing bush 14.

The compression spring 32 and the annular disk 36, and preferably also the securing ring 38, are accommodated in the cylindrical depression 24 of the bearing bush 14.

The compression spring 32 and the annular disk 36, preferably also the securing ring 38, accommodated in the cylindrical depression 24 of the bearing bush 14.

In using only one or a plurality of compression springs 32 and/or none or a plurality of annular disks 36, the spring force of this compression spring and/or the spring excursion can be set. Moreover, at least one adjusting disk can likewise be inserted between the compression spring 32 and the outwardly pointing end face 34 of the bearing bolt 6.

The inner end portion 10 of the bearing bolt 6 has, in its region projecting beyond the bearing-bolt annular collar 26, a diametrical bore 42, into which a coupling bolt 44 is inserted which projects diametrically beyond the inner end portion 10 on both sides.

Arranged in the clean-cloth spindle 4 and connected fixedly in terms of rotation to it is a coupling piece 48 which forms, toward the spindle end, longitudinal grooves 50 and 52 located diametrically opposite one another.

When this spindle end of the clean-cloth spindle 4 is slipped onto the inner end portion 10 of the bearing bolt 6, its coupling bolt 42 engages into the longitudinal grooves 50 and 52 of the coupling piece 48, 50 that the clean-cloth spindle 4 is connected fixedly rotation to the bearing bolt 6.

Figure 2:
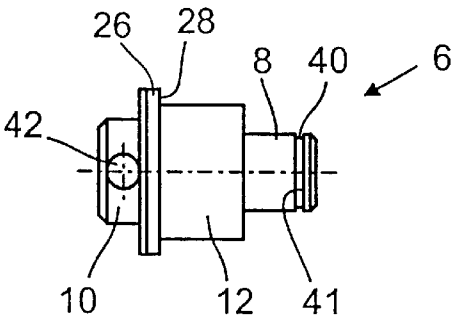
FIG. 2 shows a bearing bolt from FIG. 1, illustrated as being rotated through 90 degrees about its axis of rotation.

FIG. 2 shows the bearing bolt 6 of FIG. 1, rotated through 90 degrees about its axis of rotation. It shows the circumferential groove 40 on the outer end portion 8 of the bearing bolt 6, into which the securing ring 38 in FIG. 1 is inserted and the ring is supported on the groove end face 41 pointing axially toward the end face 28 of the annular collar 26, which end face, in turn, is supported on the inner end face 30 of the bearing shell 14 counter to the force of the compression spring 32, so that these two pressure surfaces 28 and 30 form disk-brake surfaces which prevent the clean-cloth spindle 4 from rotating more quickly than the cleaning cloth is wound from it onto a dirty-cloth spindle. This avoids a loosening and sagging of the cleaning cloth and therefore also the risk of the cleaning cloth being carried along by the printing machine cylinder to be cleaned.

Figure 4:
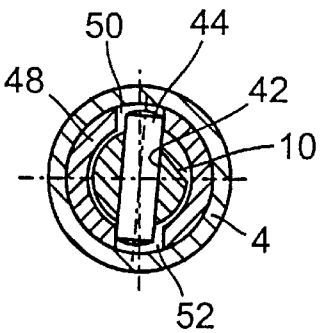
FIG. 4 shows a cross section along the plane IV—IV, as seen in the direction of the arrows of FIG. 1.
Figure 3:
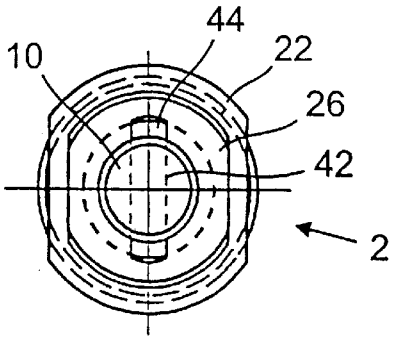
FIG. 3 shows a cross section along the plane III—III, as seen in the direction of the arrows of FIG. 1, without the clean-cloth spindle, so that only a bearing and braking unit is shown in an end view.

FIGS. 3 and 4 show views along the planes III—III and IV—IV of FIG. 1. The clean-cloth spindle 4 is not shown in FIG. 3.

Figure 5:
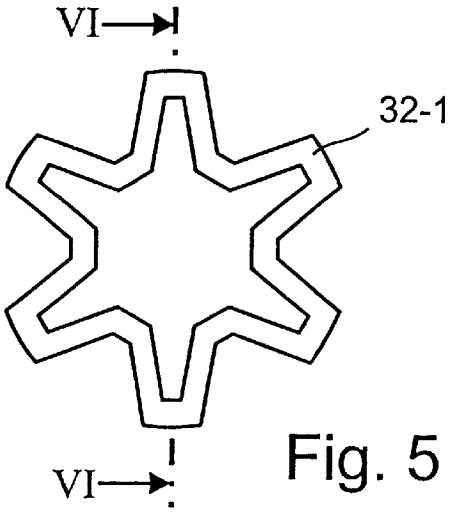
FIG. 5 shows an enlarged end view of a star spring shown in FIG. 1.
Figure 6:
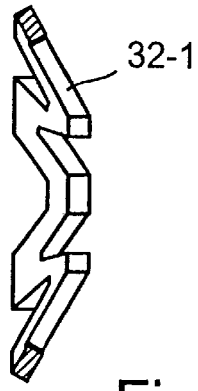
FIG. 6 shows an axial section along the plane VI—VI from FIG. 5.

FIGS. 5 and 6 show, enlarged, what is known as a star spring which can be used as a compression spring 32 according to FIG. 1 and is therefore given the reference numeral 32-1 here.

Figure 7:
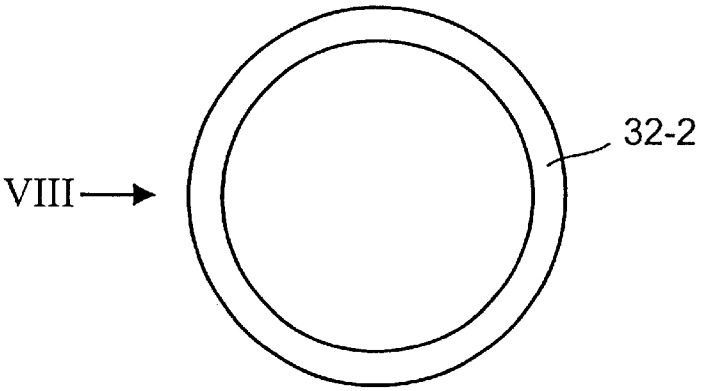
FIG. 7 shows an end view of a shaft spring ring which can be used instead of the star spring of FIGS. 5 and 6.
Figure 8:
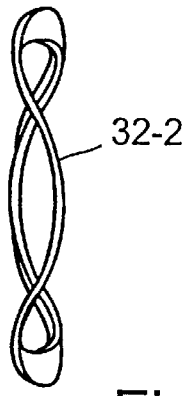
FIG. 8 shows a side view of the shaft spring ring from FIG. 7, as seen in the direction of the arrow VIII there.

FIGS. 7 and 8 show what is known as a shaft spring ring 32-2 which can be used, according to FIG. 1, as a compression spring 32.

According to FIG. 1, the clean-cloth spindle 4 is mounted freely rotatably, at its end facing away from the bearing and braking unit 2, on a bearing bolt 62 which, together with a bearing bush 64, forms a further structural unit 60. The bearing bush 64 has an external thread 66 with which it is screwed into an internal thread 67 of a further side part 70 of the cleaning device. The further side part 70 is arranged at an axial distance from the first side part 20. The bearing bush 64 has, at its inner end, an annular collar 72 which has a larger diameter than the external thread 66 of the bearing bush and which comes to bear on an inner face of the side part 70.

The bearing bolt 62 of the bearing unit 60 shown on the left in FIG. 1 can be drawn axially out of a bearing bore 76 of the clean-cloth spindle 4 counter to the force of a compression spring 74. After the bearing bolt 62 has been drawn out of the bearing bore 76, the clean-cloth spindle 4 can be pivoted transversely and then also drawn off from the bearing bolt 6 of the bearing and braking unit 2 at the other spindle end. The insertion of the clean-cloth spindle takes place in reverse order.

The compression spring 74 of the bearing unit 60 is located within the bearing bush 64 and is clamped with prestress, on the one hand, at a radially outward-projecting annular collar 78 of the bearing bolt 62 and, on the other hand, at a radially inward-projecting annular collar 80 of a bearing bore 82 of the bearing bush 64. The annular collar 78 is mounted rotatably in the bearing bore 82.

A securing ring 84 inserted into a circumferential groove 83 of the bearing bolt 62 is supported on the outside of the radially inward-projecting projection or annular collar 80 of the bearing bore 82 and thereby defines the spring prestress and the spring excursion by which the bearing bolt 62 can be moved relative to the bearing bush 64 in the direction of the clean-cloth spindle 4 by the compression spring 74.

The bearing bolt 62 has, at its outer end, a grip 86 for drawing the bearing bolt out of the bearing bore 76 of the clean-cloth spindle 4 counter to the spring force.

Figure 9:
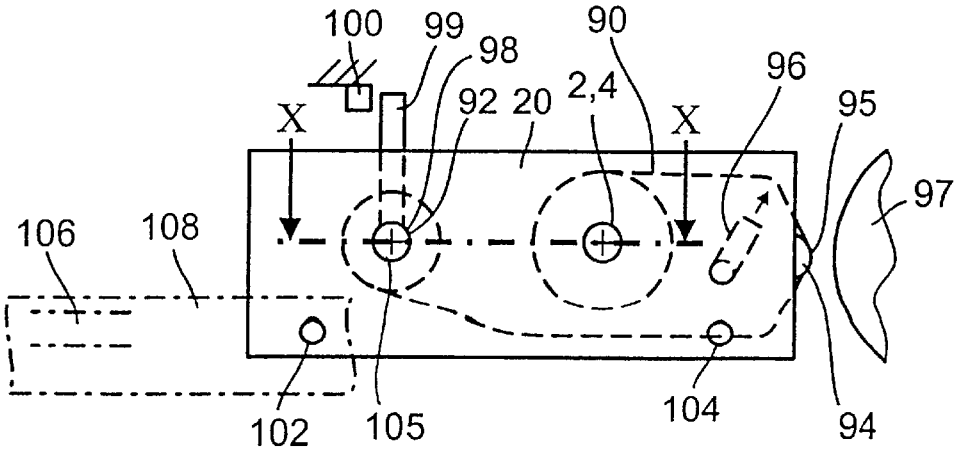
FIG. 9 shows diagrammatically a side view of the cleaning device according to the invention, designed as a washing beam, for washing the outer surface of printing machine cylinders.

FIG. 9 shows diagrammatically a side view of the cleaning device designed as a washing beam. The cleaning cloth 90 is drawn off in steps from the clean-cloth spindle 2 by a dirty-cloth spindle 92 via a pressure element 94 and is wound on. A spray device 96 moistens the cleaning cloth 90 on its path from the clean-cloth spindle 4 to the pressure element 94 or directly at this pressure element 94. The dirty-cloth spindle 92 is provided with a freewheel drive 98 which has in a known way a freewheel bearing 105 in this dirty-cloth spindle 2 and an advancing lever 99. When the washing beam is moved back from a washing position into the basic position shown in FIG. 9, the advancing lever 99 is prevented by a fixed stop 100 from following the movement of the washing beam, so that the advancing lever 99 rotates the dirty-cloth spindle 92 by means of the freewheel bearing 105. During the opposite movement of the washing beam from the basic position shown in FIG. 9 into a washing position, the advancing lever 99 is rotated back automatically by means of a spring 91, without driving the dirty-cloth spindle 92. In the washing position, not shown, the pressure element 94 presses the washing-cloth portion 95 lying on it against the outer surface of a printing machine cylinder 97 to be cleaned. The printing machine cylinder 97 may be, in particular, a rubber-blanket cylinder of an offset printing machine, but also any other type of cylinder in a printing machine.

The washing beam has, on its outer faces, bolts or rollers 102 and 104 engaging into grooves 106 of a holding device 108 which is indicated merely diagrammatically in FIG. 9 by dashed and dotted lines, since such holding devices are known.

Figure 10:
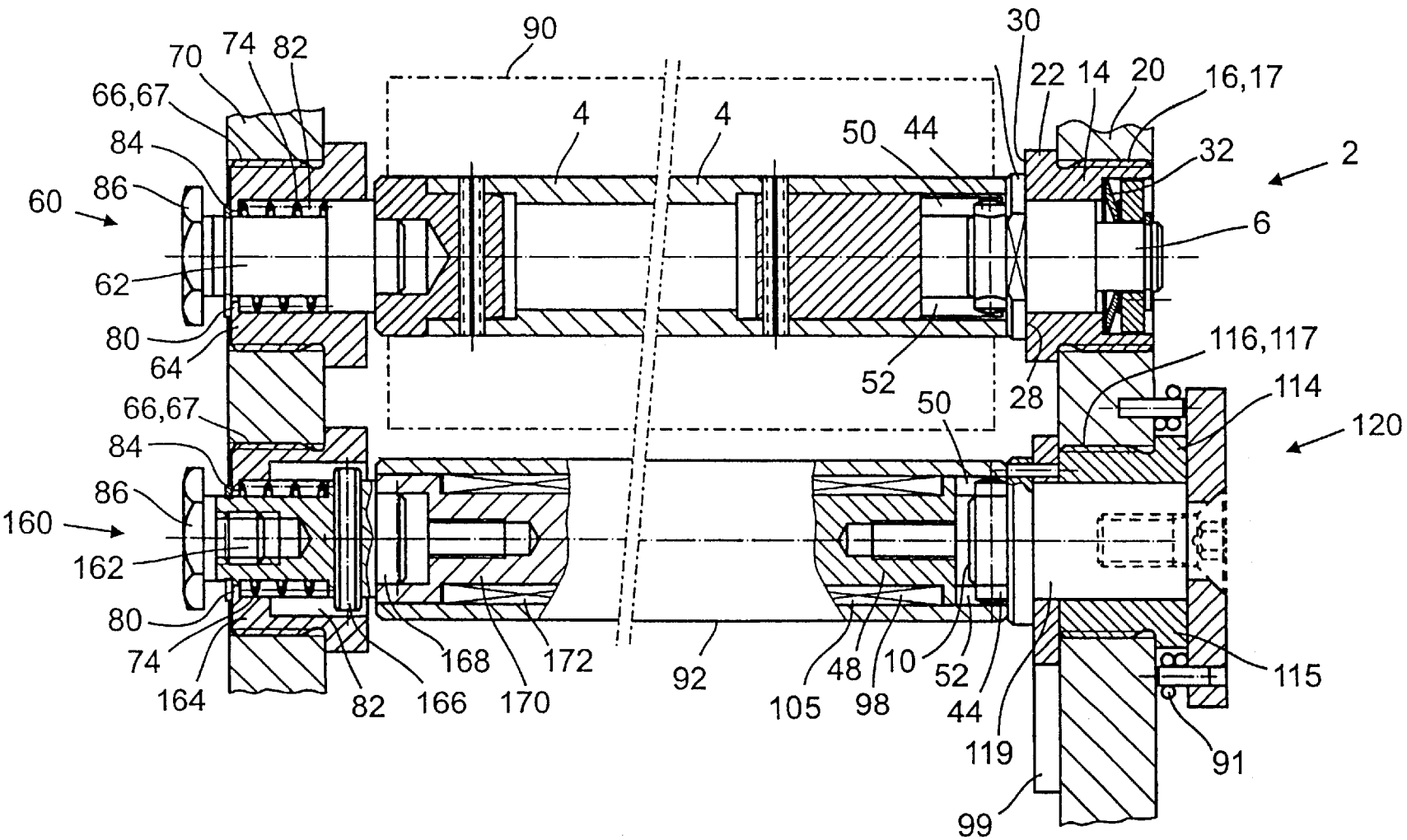
FIG. 10 shows a cutaway longitudinal section along the plane X—X of FIG. 9, which shows the mounting of the clean-cloth spindle and of the dirty-cloth spindle in side parts of the cleaning device.

FIG. 10 shows, by dashed and dotted lines, the cleaning cloth 90 wound on the clean-cloth spindle 4 and the two bearings 2 and 62 of this clean-cloth spindle 4 according to FIG. 1.

FIG. 10 additionally shows a top view of the dirty-cloth spindle 92. At one end, shown on the right in FIG. 10, it is mounted rotatably by means of a bearing unit 120. This is a sliding bearing and has a bearing bush 114 with an external thread 116, with which it is screwed into a threaded bore 117 of one side part 20 from the outer face of the latter. The bearing bush 114 has a radially outward-projecting annular collar 115 which comes to bear on the outer face of this side part 20. A bearing bolt 119 mounted rotatably in the bearing bush 114 has, on its end portion 10 projecting inward from the bearing bush, a coupling bolt 44 which projects diametrically from said end portion on both sides and which engages into recesses 50 and 52 of a coupling piece 48 which are located diametrically opposite one another. The coupling piece 48 is mounted by means of the freewheel bearing 105 fixedly in terms of rotation with the dirty-cloth spindle 92 only in the direction of rotation of the cloth advance, but freely rotatably in the opposite direction of rotation. The advancing lever 99 is fastened fixedly in terms of rotation to the outer end of the bearing bolt 119.

The left-hand other end of the dirty-cloth spindle 92 is mounted rotatably on the other side part 70 by means of a bearing unit 160. The bearing unit 160 contains a bearing bush 164 with an external thread 66 with which said bearing bush is screwed into an internal thread 67 of the side part 70. A bearing bolt 162 with a grip part 86 can be drawn, counter to the spring force of a compression spring 74 accommodated in the bearing bush 164, out of that end portion of the dirty-cloth spindle 92 which is to be mounted. After said bearing bolt has been drawn out, the dirty-cloth spindle 92 can be pivoted away laterally and then be drawn off from the bearing bolt 10 of the first bearing 120 which is provided with the freewheel drive 98. Parts which are the same as those in FIG. 1 are given the same reference numerals in FIG. 10. The bearing bolt 162 is connected fixedly in terms of rotation to the bearing bush 164 by means of a crosspin 166, but is axially displaceable relative to the bearing bush 164. An inner end portion 168 of the bearing bolt 162 is inserted axially into a coupling piece 170 and is connected fixedly in terms of rotation therein by means of a positive connection (of oval or annular cross section). The coupling piece 170 is arranged in the dirty-cloth spindle 92 and is freely rotatable relative to the latter in the same direction of rotation as the coupling piece 48 of the bearing unit 120 which is provided with the freewheel drive 98. In the opposite direction of rotation, the coupling piece 170 is coupled fixedly in terms of rotation to the dirty-cloth spindle 92 by means of a freewheel bearing 172.

What is claimed is:

1. A cleaning device for printing machine cylinders, the cleaning device comprising:

a clean cloth spindle for supplying a clean cloth, the clean cloth spindle having first and second opposite ends and first and second spindle bearing units at the respective first and second ends of the clean cloth spindle for rotatable mounting of the clean cloth spindle, the first and second bearing units having respective first and second bearing bushes;

a dirty cloth spindle spaced from the clean cloth spindle for receiving a dirty cloth after it has passed from the clean cloth spindle to the dirty cloth spindle; the dirty cloth spindle having third and fourth opposite ends and third and fourth spindle bearing units at the respective third and fourth ends of the dirty cloth spindle for rotatable mounting of the dirty cloth spindle, the third and fourth bearing units having respective third and fourth bearing bushes, wherein the clean cloth spindle and the dirty cloth spindle are rotatable at their bearing units in order to wind a clean cloth from the clean cloth spindle onto the dirty cloth spindle, the path of cloth movement between the clean cloth spindle and the dirty cloth spindle being arranged to bring a portion of the cloth moving between the spindles selectively into and out of contact with a printing machine cylinder to be cleaned;

opposing spaced apart first and second side parts of the cleaning device, the first and third bearing bushes of the clean cloth spindle and the dirty cloth spindle respectively being secured to the first side part, and the second and fourth bearing bushes of the clean cloth spindle and the dirty cloth spindle respectively being secured to the second side part;

at one of the bearing bushes at each of the first and second spindles, a respective first bearing bolt disposed in the one bearing bush at each of the first and second spindles, each first bearing bolt having an inner end portion which is insertable for forming an insertion connection with one respective end of the respective spindle to be carried by the respective spindle end; each first bearing bolt also having an outer end portion provided with a grip which projects axially outward from the respective bearing bush, whereby the grip can be gripped for drawing the respective bearing bolt outward axially relative to the respective bearing bush and also off the respective one spindle end;

a respective compression spring in the one bearing bush, and clamped with axial prestress between the respective one bearing bush and the respective first bearing bolt and normally urging the first bearing bolt axially inward in the direction of the respective one spindle end, and urging the grip counter to the axial prestress of the respective compression spring;

a respective second bearing bolt disposed in the other one of the bearing bushes at each of the spindles, each second bearing bolt having an inner end portion which is an insertable coupling part for coupling to the respective other spindle end and the connection between the end portion of the second bearing bolt and the other spindle end is a rotationally fixed coupling, whereby the second bolts rotate together with the respective first and second spindles;

each of the bearing bushes includes a respective external thread, the first and second side parts have internal threads located at the bearing bushes, and each external thread of one of the bearing bushes is screwed into a respective one of the internal threads at one of the side parts;

each of the bearing bushes has a respective annular collar that projects radially outwardly beyond the respective external thread of the bush, and each collar being disposed for defining axial support on the respective side part to which the respective bearing bush is attached and the collars being positioned for limiting the axial screw in depth of the respective bearing bushes into the respective side parts, wherein the respective other bearing bush and the respective second bearing bolt of the other spindle end of the clean cloth spindle are respectively so shaped as to define opposing end faces, with the end face of the second bearing bolt facing outwardly and the other end face of the other bearing bush facing inwardly;

at least one respective spring clamped axially with prestress between the other bearing bush and the second bearing bolt at the other spindle end for generating a rotational frictional resistance between the other bearing bush and the second bearing bolt, which resistance is overcome through enabling rotation of the second bearing bolt relative to the other bearing bush.

2. The cleaning device of claim 1, wherein at the other spindle end of the dirty cloth spindle, the second bearing bolt has an insertable coupling part;

a free wheel drive for the second bearing bolt in the dirty cloth spindle, the free wheel drive having a rotary drive element which is corotateable with the second bearing bolt only in one direction of rotation and not corotateable in the opposite direction, so that the cloth might be wound on the dirty cloth spindle but not unwound therefrom back toward the clean cloth spindle.

3. A cleaning device for printing machine cylinders, the cleaning device comprising:

a clean cloth spindle for supplying a clean cloth, the clean cloth spindle having first and second opposite ends and first and second spindle bearing units at the respective first and second ends of the clean cloth spindle for rotatable mounting of the clean cloth spindle, the first and second bearing units having respective first and second bearing bushes;

a dirty cloth spindle spaced from the clean cloth spindle for receiving a dirty cloth after it has passed from the clean cloth spindle to the dirty cloth spindle;

the dirty cloth spindle having third and fourth opposite ends and third and fourth spindle bearing units at the respective third and fourth ends of the dirty cloth spindle for rotatable mounting of the dirty cloth spindle, the third and fourth bearing units having respective third and fourth bearing bushes, wherein the clean cloth spindle and the dirty cloth spindle are rotatable at their bearing units in order to wind a clean cloth from the clean cloth spindle onto the dirty cloth spindle, the path of cloth movement between the clean cloth spindle and the dirty cloth spindle being arranged to bring a portion of the cloth moving between the spindles selectively into and out of contact with a printing machine cylinder to be cleaned;

opposing spaced apart first and second side parts of the cleaning device, the first and third bearing bushes of the clean cloth spindle and the dirty cloth spindle respectively being secured to the first side part, and the second and fourth bearing bushes of the clean cloth spindle and the dirty cloth spindle respectively being secured to the second side part;

at one of the bearing bushes at each of the first and second spindles, a respective first bearing bolt disposed in the one bearing bush at each of the first and second spindles, each first bearing bolt having an inner end portion which is insertable for forming an insertion connection with one respective end of the respective spindle to be carried by the respective spindle end; each first bearing bolt also having an outer end portion provided with a grip which projects axially outward from the respective bearing bush, whereby the grip can be gripped for drawing the respective bearing bolt outward axially relative to the respective bearing bush and also off the respective one spindle end;

a respective compression spring in the one bearing bush, and clamped with axial prestress between the respective one bearing bush and the respective first bearing bolt and normally urging the first bearing bolt axially inward in the direction of the respective one spindle end, and urging the grip counter to the axial prestress of the respective compression spring;

a respective second bearing bolt disposed in the other one of the bearing bushes at each of the spindles, each second bearing bolt having an inner end portion which is an insertable coupling part for coupling to the respective other spindle end and the connection between the end portion of the second bolt and the other spindle end is a rotationally fixed coupling, whereby the second bolts rotate together with the respective first and second spindles;

each of the bearing bushes includes a respective external thread, the first and second side parts have internal threads located at the bearings bushes, and each external thread of one of the bearing bushes is screwed into a respective one of the internal threads at one of the side parts;

each of the bearing bushes has a respective annular collar that projects radially outwardly beyond the respective external thread of the bush, and each collar being disposed for defining axial support on the respective side part to which the respective bearing bush is attached and the collars being positioned for limiting the axial screw in depth of the respective bearing bushes into the respective side parts, wherein the device is a structural unit that together is moveable back and forth in a holding device, in which the cleaning device is supported for movement relative to a printing machine cylinder to be cleaned;

the cleaning device having a basic position wherein the cleaning device is at a predetermined distance from the printing machine cylinder and having a cleaning position in which a portion of the cleaning cloth is moved to bear against the printing machine cylinder to be cleaned as the cloth moves from the clean cloth cylinder to the dirty cloth cylinder.

4. The cleaning device of claim 3, wherein at the other spindle end of the dirty cloth spindle, the second bearing bolt has an insertable coupling part;

a free wheel drive for the second bearing bolt in the dirty cloth spindle, the free wheel drive having a rotary drive element which is corotateable with the second bearing bolt only in one direction of rotation and not corotateable in the opposite direction, so that the cloth might be wound on the dirty cloth spindle but not unwound therefrom back toward the clean cloth spindle.

5. The cleaning device of claim 3, wherein the spring of the one bearing unit of each of the clean cloth spindle and the dirty cloth spindle comprises a compression spring;

further comprising a radially inwardly projecting annular collar of the one bearing bush at the one spindle end and a radially outwardly projecting annular collar of the respective first bearing bolt and the compression spring is clamped between the collars, with the collars on the bearing bush and the bolt being disposed so that the spring urges the bearing bolt axially inwardly.

* * * * *